United States Patent [19]

Ross

[11] 3,972,256

[45] Aug. 3, 1976

[54] MEAT SLICER

[76] Inventor: Henry M. Ross, The Lawn, Nokesville, Va. 22123

[22] Filed: May 30, 1975

[21] Appl. No.: 582,149

[52] U.S. Cl. ..... 83/155; 83/409.2; 83/411 A

[51] Int. Cl.[2] ..... B26D 4/22; B26D 4/46; B26D 7/06

[58] Field of Search ..... 83/409.2, 411 A, 155

[56] References Cited

UNITED STATES PATENTS

| | | | |
|---|---|---|---|
| 1,366,568 | 1/1921 | Knapp | 83/409.2 |
| 3,867,858 | 2/1975 | Tsuchiya et al. | 83/411 A X |

*Primary Examiner*—Willie G. Abercrombie

[57] ABSTRACT

Two meat hoppers are disposed vertically above a crescent-shaped plate member which is vertically adjustable. A circular blade is mounted concentrically with the crescent portion of the plate and between the plate and the hoppers. Two conveyers are positioned under the plate beneath the hoppers. The plate and blade rotate together about the central axis of the plate while the circular blade rotates about its own axis. Meat logs placed in the hoppers rest on the plate and are sliced alternately by the blade as the blade and plate assembly rotates. The slices drop on the conveyors.

1 Claim, 3 Drawing Figures

MEAT SLICER

BACKGROUND OF THE INVENTION

In the meat processing industry it has been a common practice for many years to form meat into rolls or "logs", as they are called, with various cross-sectional shapes. Processed lunchmeats are probably the most familiar example of this. Ham, chicken and turkey are formed into round or square logs for sale by individual slicing in delicatessens, or sliced and pre-packaged for sale in supermarkets. In the marketing of pre-packaged frozen meats where portion control is desired, beef and pork are also formed into desired cross-sectional shapes and then are sliced into individual portions of uniform size and shape.

Economical handling and processing of pre-packaged slices from meat logs requires a slicing mechanism which can operate at high speeds and deliver meat slices of consistent quality with selective adjustment for thickness of cut. In order to present attractive packaging, the meat slices must be perfectly flat with no curving of the meat surface. There are many conventional slicing machines available, but the principal drawback with the available machinery is the speed and efficiency of operation and the appearance of the sliced product.

SUMMARY OF THE INVENTION

In accordance with the present invention the disadvantages of the prior art are eliminated in a meat slicer which comprises two stationery meat hoppers disposed vertically above a crescent-shaped plate which is vertically adjustable, and which rotates about a vertical central machine axis. A circular blade member is mounted between the crescent-shaped plate and the hoppers in a plane perpendicular to the axis of the hoppers and parallel to the central axis of the machine. The circular blade rotates about its own axis and also with the crescent-shaped plate about the central axis such that the meat logs, which are supported by the crescent-shaped plate, are engaged alternately by the rotating circular blade to slice the meat logs in a thickness determined by the spacing between the blade and the crescent-shaped plate. As the logs are sliced, the slices drop onto one of a pair of conveyors that carry the slices out from under the blade and plate assembly.

DESCRIPTION OF THE PREFERRED EMBODIMENT

Figure 1:
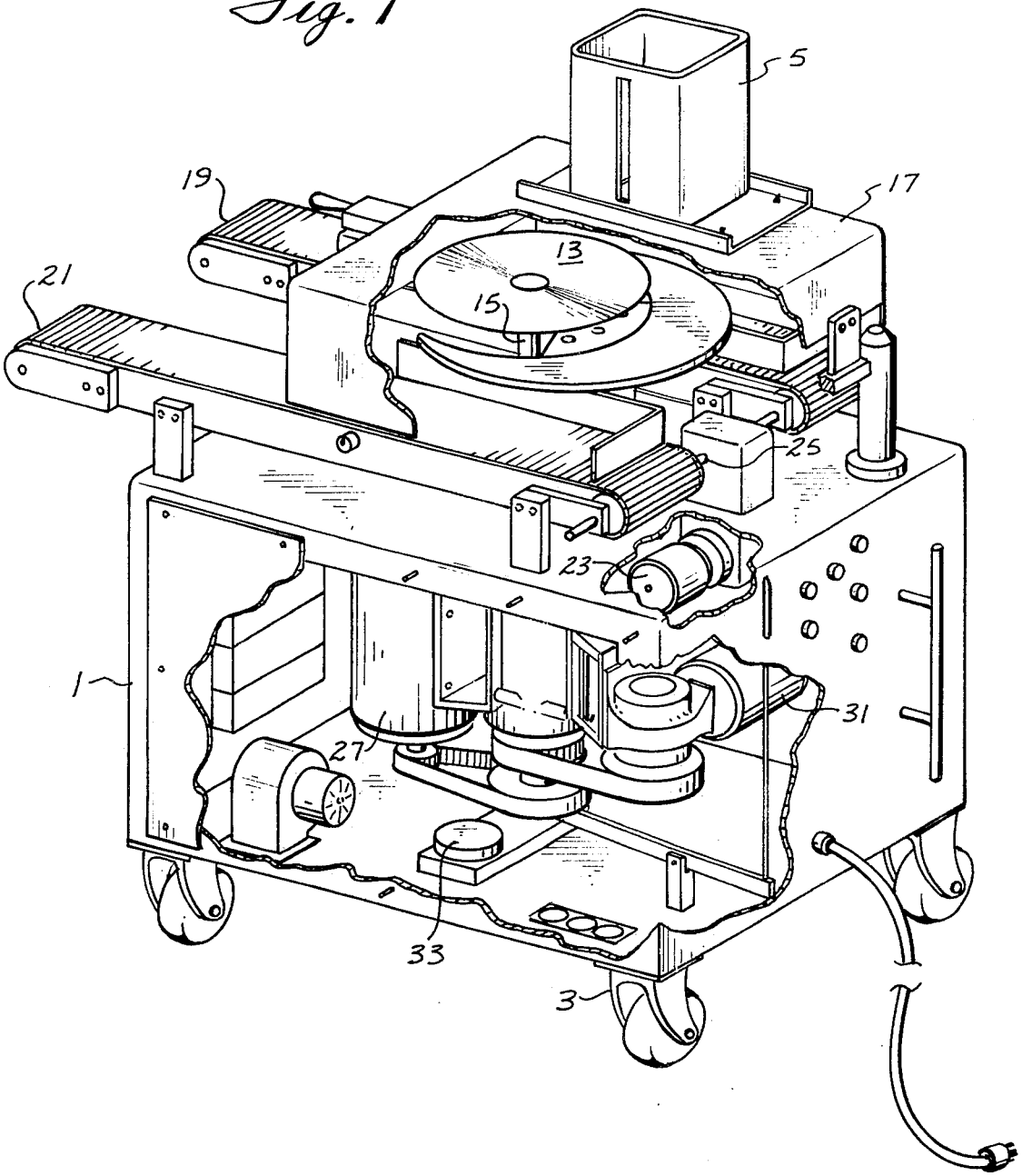
FIG. 1 of the drawing is a perspective view of a machine incorporating the features of the invention with portions cut away to show internal parts.
Figure 2:
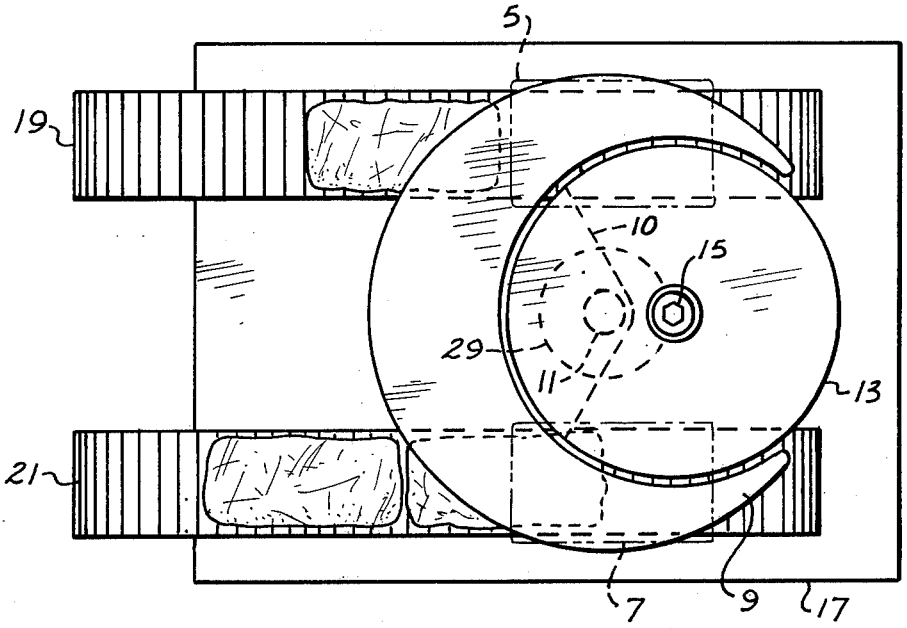
FIG. 2 is a top view of the slicing and conveying mechanism showing the blade and plate assembly in one position.
Figure 3:
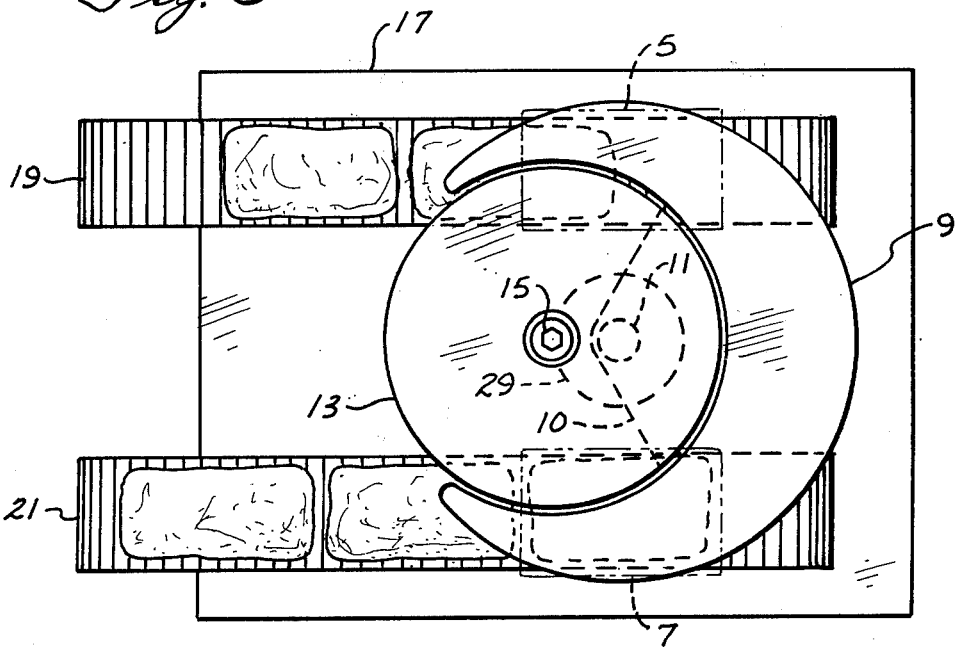
FIG. 3 is a top view similar to FIG. 2 with the blade and plate assembly in a position 180° removed from that of FIG. 2.

The invention will be understood more readily by referring to the drawing in which FIG. 1 is perspective view of a machine constructed in accordance with the invention. The meat slicing machine is indicated generally by the numeral 1. The machine is mounted on casters, such as shown at 3, so that it may be easily rolled about to any desired location. A conventional power cord is provided to utilize any convenient electrical source. The majority of the exposed parts of the machine are preferably constructed of stainless steel for cleanliness and durability.

A pair of meat hoppers 5 and 7 are removably mounted, as with screws, on hinged housing member 17. Within housing member 17 is a crescent-shaped plate 9 mounted on shaft 11 by means of web member 10. Shaft 11 is disposed in vertical relationship and is concentric with the central axis of plate member 9.

A circular blade member 13 is disposed parallel to crescent-shaped plate member 9 between plate member 9 and the meat hoppers 5 and 7. The circular blade 13 is rotatably mounted on shaft 15. Shaft 15 is parallel to shaft 11 and spaced therefrom in fixed relationship thereto.

Conveyor members 19 and 21 are mounted beneath the crescent-shaped plate 9 and disposed in respective alignment with meat hoppers 5 and 7. A drive motor 23 is provided to rotate shaft 25 and produce longitudinal movement of the conveyors 19 and 21.

Motor 27 is provided to rotate shaft 15 through gear box 29. Motor 31 is provided to rotate shaft 11 through gear box 29. Shafts 11 and 15 are both driven from gear box 29 which provides a fixed relationship between the two shafts. With this arrangement motor 31 rotates shaft 11 which is fixed to gear box 29 and thereby causes circular blade 13 on shaft 15 to rotate therewith. While circular blade 13 is rotating about axis 11 with plate member 9, the blade motor 27 causes circular blade 13 to rotate about shaft 15.

Meat logs are placed in meat hoppers 5 and 7 and passed through housing 17 to rest upon crescent-shaped plate member 9. As the circular blade and crescent-shaped plate assembly is driven by blade motor 27 and plate drive motor 31, the meat logs contained in hoppers 5 and 7 are sliced in alternate fashion. When circular blade 13 passes through a meat log, the severed slice drops through the crescent aperture onto the conveyor therebeneath and is carried out from under housing 17. The thickness of the slices is regulated by a motor-driven jack-screw arrangement shown at 33 which raises and lowers crescent-shaped plate member 9 to vary the spacing between circular blade 13 and plate 9 to achieve the desired thickness of cut. Appropriate controls are provided on the side of the machine to regulate independently all of the machine functions.

The compound circular motion of the crescent-shaped plate and circular blade combination on the vertical axis in relationship to the fixed vertical hoppers enables a single operator to slice different pieces or shapes of meat which are not intermixed, but are maintained on separate conveyors. The removable meat hoppers add a versatility to the machine by enabling the operator at will to slice various cross-sectional configurations of meat. Appropriate electrical interlocks are provided to shut off the machine when dangerous parts are exposed.

What is claimed is:

1. A meat slicer comprising a horizontally disposed crescent-shaped plate member mounted for rotation about a central axis, a pair of hopper members removably mounted above and perpendicular to the surface of said crescent-shaped plate member, said hopper members being adapted to contain elongated portions of meat to be sliced, a circular blade member mounted concentrically with said crescent portion between said plate member and said hopper members and parallel to said crescent-shaped plate member, the axis of said circular blade member being parallel to, spaced from and in fixed relationship to said central axis, a conveyor for each hopper member mounted below said crescent-shaped plate member and in alignment with said hopper member, means to rotate said crescent-shaped plate member and said circular blade member about said central axis, and means to rotate said circular blade member about its own axis while said blade member is rotating about said central axis, whereby meat in each of said hopper members rests upon said crescent-shaped plate member and is sliced by said circular blade member to fall through the crescent portion of said plate member onto said conveyor.

* * * * *